US011421490B2

(12) United States Patent
Holtby

(10) Patent No.: US 11,421,490 B2
(45) Date of Patent: Aug. 23, 2022

(54) ADJUSTABLE CONTAINMENT ENVELOPE

(71) Applicant: Katch Kan Holdings Ltd., Edmonton (CA)

(72) Inventor: Quinn A. J. Holtby, Edmonton (CA)

(73) Assignee: Katch Kan Holdings Ltd., Edmonton (CA)

( * ) Notice: Subject to any disclaimer, the term of this patent is extended or adjusted under 35 U.S.C. 154(b) by 0 days.

(21) Appl. No.: 15/215,475

(22) Filed: Jul. 20, 2016

(65) Prior Publication Data

US 2017/0022787 A1 Jan. 26, 2017

Related U.S. Application Data

(60) Provisional application No. 62/194,549, filed on Jul. 20, 2015.

(51) Int. Cl.
*E21B 21/015* (2006.01)
*E21B 21/01* (2006.01)

(52) U.S. Cl.
CPC ..... *E21B 21/015* (2013.01); *E21B 21/01* (2013.01)

(58) Field of Classification Search
CPC ..... E21B 21/015
See application file for complete search history.

(56) References Cited

U.S. PATENT DOCUMENTS 1,233,784 A 7/1917 Hutchison
1,943,191 A 1/1934 Schwemlein
2,096,882 A 10/1937 Chernosky
2,505,282 A 4/1950 Endsley
3,186,722 A 6/1965 Johnston
3,374,929 A 3/1968 Silfverskiold
RE27,425 E * 7/1972 Hall et al. ..... E21B 37/02 166/173
4,167,235 A 9/1979 Green
4,450,905 A 5/1984 Crain
4,492,294 A 1/1985 Ball
4,518,106 A 5/1985 LaFleur
4,520,852 A 6/1985 Klein
4,553,637 A 11/1985 Tanner
5,098,220 A 3/1992 Norman
5,121,796 A * 6/1992 Wigington, Sr. ..... E21B 21/01 166/379

(Continued)

OTHER PUBLICATIONS

Katch Kan, "Adjustable Containment Enclosure (ACE)," Product Info Sheet, Feb. 14, 2014, 1 page.

(Continued)

*Primary Examiner* — Robert E Fuller
*Assistant Examiner* — Neel Girish Patel
(74) *Attorney, Agent, or Firm* — Christensen O'Connor Johnson Kindness PLLC

(57) ABSTRACT

A covering for a rig structure has plural segments separably connected together to form a loop to enclose a portion of a rig structure. Segments can be added or removed to adjust the size of the covering. A lower edge of the covering is connected around a containment basin suspended from the rig structure to contain fluids captured by the covering. An upper edge of the covering is connected to an adjustable frame suspended from the rig structure. The frame can be raised after the covering is attached to it to tauten the covering.

13 Claims, 3 Drawing Sheets

(56) References Cited

U.S. PATENT DOCUMENTS

| | | | | |
|---|---|---|---|---|
| 5,167,277 | A * | 12/1992 | Evans | E21B 21/01 166/81.1 |
| 5,186,577 | A | 2/1993 | Reicin et al. | |
| 5,211,244 | A | 5/1993 | Arterbury | |
| 5,315,721 | A | 5/1994 | Okun | |
| 5,428,922 | A * | 7/1995 | Johnson | A01G 9/023 47/62 R |
| 5,484,024 | A | 1/1996 | Ladd et al. | |
| 5,634,485 | A * | 6/1997 | Holtby | E21B 21/01 137/15.01 |
| 6,386,225 | B1 * | 5/2002 | Holtby | E21B 33/08 137/15.01 |
| 6,666,287 | B2 * | 12/2003 | Holtby | E21B 21/01 175/209 |
| 7,661,157 | B2 * | 2/2010 | McCluskey | A47D 13/063 5/99.1 |
| 9,453,392 | B1 * | 9/2016 | Marchiori | E21B 21/01 |
| 2003/0079914 | A1 * | 5/2003 | Holtby | E21B 21/01 175/207 |
| 2011/0265378 | A1 * | 11/2011 | Callaway | A01G 13/0281 47/1.01 R |
| 2017/0121066 | A1 * | 5/2017 | Rogers | B65F 1/1607 |

OTHER PUBLICATIONS

Swift Environmental, "Swift Saver™, Drilling Fluid Containment & Recovery System," pamphlet, 2013, pp. 1-12.

* cited by examiner

ADJUSTABLE CONTAINMENT ENVELOPE

TECHNICAL FIELD

Spill prevention for rig structures, for example oil drilling rigs.

BACKGROUND

When drill pipe is tripped from an oil well, the exterior of the drill pipe is covered with oil and the interior of the pipe invariably contains drilling fluid. Environmental regulations relating to the operation of drilling rigs are becoming increasingly strict regarding oil contamination. Some geographical areas in which oil drilling takes place are known for their strong prevailing winds. In such locations, the strong winds tend to blow oil from the drilling rig onto the surrounding environment. For the comfort and safety of the rig hands and the protection of the environment, it has become the practice in the industry to cover an area of a drilling rig working with tarps in a geographical area with strong prevailing winds. The tarps are secured in position by ropes. The installation of the tarps is a time consuming process which takes between 10 and 14 hours, as the rig hands must climb the drilling rig in order to tie the tarps into place with ropes. It is also a dangerous procedure, as there is always a danger of the rig hands falling; especially when the prevailing winds are blowing as they try to climb the drilling rig and unfurl tarps.

In order to address the above mentioned problems, Katch Kan has previously developed and patented (CA Patent No. 2360234C, U.S. Pat. No. 6,666,287) a method and apparatus for enclosing a rig structure. The previously developed covering was adjustable to an insufficient degree for some applications, particularly where only a small amount of space was available.

SUMMARY

There is provided a method for enclosing a rig structure, comprising the steps of providing a base and a flexible sheet-form covering having a first edge and a second edge, the flexible sheet form comprising plural sheet-form segments separably connected in series in a direction generally perpendicular to the first edge and the second edge, arranging the flexible sheet-form covering around a portion of the rig structure, connecting the sheet-form segments together to form a loop around the portion of the rig structure, securing the base to the rig structure, securing the first edge of the covering around the perimeter of the base, and securing the second edge of the covering in spaced relation to the base with tension applied to the covering to maintain the covering in a substantially taut condition.

In various embodiments, there may be included any one or more of the following features: the circumferential size of the covering may be reduced by removing one or more segments and the connecting together the remaining segments. The circumferential size of the covering may be increased by separating two segments and connecting one or more additional segments into the covering by connecting the one or more additional segments to the separated segments. The step of securing the base to the rig structure may comprise at least in part supporting the base by suspending the base from a structural element of the rig structure. The structural element may comprise a platform of the rig structure. The second edge of the covering may be supported by suspension from a part of the rig structure. The part of the rig structure from which the covering is suspended and the structural element from which the base is suspended may be the same element. The second edge of the covering may be secured to a peripheral frame. The frame may be a telescopically adjustable annular frame. The base may comprise an oil containment basin adapted to capture and contain any oil that falls onto the base. The covering, when taut, may have at least a tubular portion. The at least a tubular portion may be funnel shaped. The covering may comprise a lower flap proximate to the first edge, and securing the first edge of the covering around the perimeter of the base may be carried out by securing the lower flap around the perimeter of the base. The covering may comprise an upper flap proximate to the second edge, and securing the second edge of the covering in spaced relation to the base may be carried out by securing the upper flap in spaced relation to the base.

There is further provided a combination comprising a rig structure, a base secured to the rig structure, a flexible sheet-form covering having a first edge and a second edge, the flexible sheet form comprising plural sheet-form segments separably connected in series in a direction generally perpendicular to the first edge and the second edge, the flexible sheet-form covering arranged around a portion of the rig structure, and the sheet-form segments connected together to form a loop around the portion of the rig structure, the first edge of the covering being secured around a perimeter of the base, and the second edge of the covering being secured in spaced relation to the base, and the covering being tensioned to maintain the covering in a substantially taut condition. In various embodiments, there may be included any one or more of the following features: the base may be secured to the rig structure at least in part by being suspended from a structural element of the rig structure. The structural element may comprise a platform of the rig structure. The second edge of the covering may be supported by suspension from a part of the rig structure. The part of the rig structure from which the covering is suspended and the structural element from which the base is suspended may be the same element. The second edge of the covering may be secured to a peripheral frame. The frame may be a telescopically adjustable annular frame. The base may comprise an oil containment basin adapted to capture and contain any oil which falls onto the base. The covering, when taut, may have at least a tubular portion. The at least a tubular portion may be funnel shaped. The covering may comprise a lower flap proximate to the first edge, and the first edge of the covering may be secured around the perimeter of the base by securing the lower flap around the perimeter of the base. The covering may comprise an upper flap proximate to the second edge, and the second edge of the covering may be secured in spaced relation to the base by securing the upper flap in spaced relation to the base.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
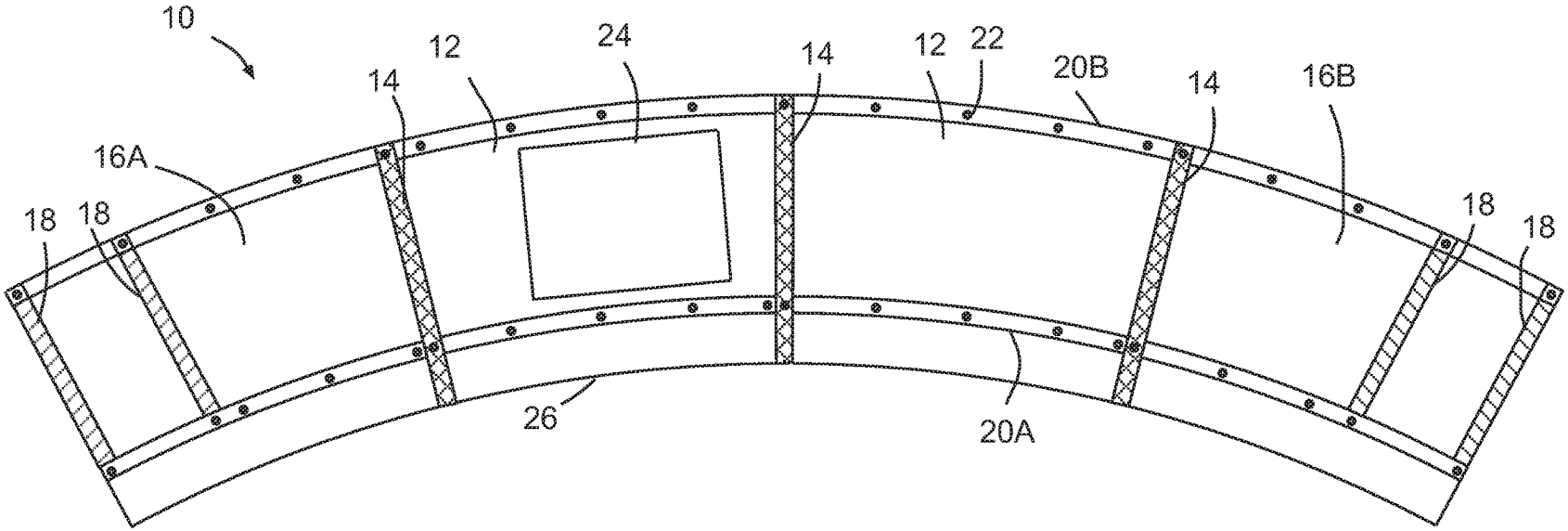
FIG. 1 is a drawing of an exemplary embodiment of a covering for a rig structure in a flat, pre-installation configuration.

Referring to FIG. 1, a covering 10 comprises multiple segments 12 separably connected with connectors 14, which in this embodiment are vertical hook-and-loop fastener (e.g., Velcro™) strips at overlapping portions of the respective segments, one segment at each connector having the hooks and the other having the loops. In the embodiment shown the loops face outward when the covering is installed on a rig structure, for example an oil drilling rig, and the hooks face inward to engage with the loops. In the embodiments shown the segments overlap and connect at straight-line shaped edge portions, but in other embodiments the segments could be any shape, and in further embodiments different connectors could be used that do not require overlap. The ends of the covering as shown can be connected together to form a loop. Each leftward connector (connector on a left edge of a segment) can connect with any of the rightward connectors (connectors on a right edge of a segment) in this embodiment and vice versa, allowing one or more segments to be removed and the remaining segments connected together to make the covering smaller circumferentially to fit into a smaller area. The term "circumferential" here is used to refer to the direction around the loop formed by the covering when installed and does not imply that the loop or any cross-section of the loop is necessarily circular. If it is desired to increase the circumferential size of the covering, a connector 14 can be disconnected and one or more additional segments 12 can be connected into the leftward and rightward portions of the disconnected connector 14. In alternative, less preferred embodiments, not all leftward connectors may be compatible with all rightward connectors, such that plural segments must be removed or added in order for the segments to be connected properly. In the embodiment shown the covering has end segments 16A and 16B adapted to be connected together, to form the covering into a loop, with an end connector comprising two hook-and-loop fastener connectors 18. This double connection allows overlap of the ends in the space between the connectors 18. The view shown in FIG. 1 is of the outside of the covering, except that end connector strips 18 of end segment 16A are shown even though they are on the inside only (end connector strips 18 of end segment 16B are on the outside). In the embodiment shown, the end connectors 18 extend less than the full vertical extent of the covering, but the other connectors 14 extend the full vertical extent. The reduced vertical extent of the end connectors 18 makes it easier to connect and disconnect them while the covering is in installed position. The covering in this embodiment has an arc-like shape pre-installation resulting in a funnel shape when installed. Other shapes could be used including for example a rectangular shape resulting in a cylindrical shape when installed. Flaps 20A, 20B extend circumferentially across the outside of the covering. Holes in the flaps may be reinforced with grommets 22 and may be used as attachment points for connecting elements (not shown) such as for example zip ties and urethane hangers and tabs. Where grommets appear to be shown in the connectors 14 of FIG. 1, they are actually in a flap portion extending over the outside of the covering where the connectors connect together the facing portions of segments 12. The covering may be installed for example by connecting lower flap 20A to a containment basin such as, for example, a Low Profile Katch Kan™ (LowPro™) or to a nearby object such that skirt 26 at the lower edge of the covering is within a containing wall of the containment basin, connecting upper flap 20B to, for example, a telescopically adjustable annular frame, and connecting the end connectors 18 together. These connections may all use connecting elements such as zip ties, hangers and tabs as mentioned above. The upper flap can also be connected to other objects such as, for example, an upper containment basin, which may also be a LowPro™. The upper flap can also connect to another covering if desired. The covering may include a patch 24 for displaying a logo and/or safety information. In an exemplary version of the embodiment shown in FIG. 1 the upper and lower flaps 20B, 20A are two feet apart measured from top edge to top edge and each segment including the end segments is approximately equal in size. Each of these features can vary depending on the embodiment.

Figure 2:
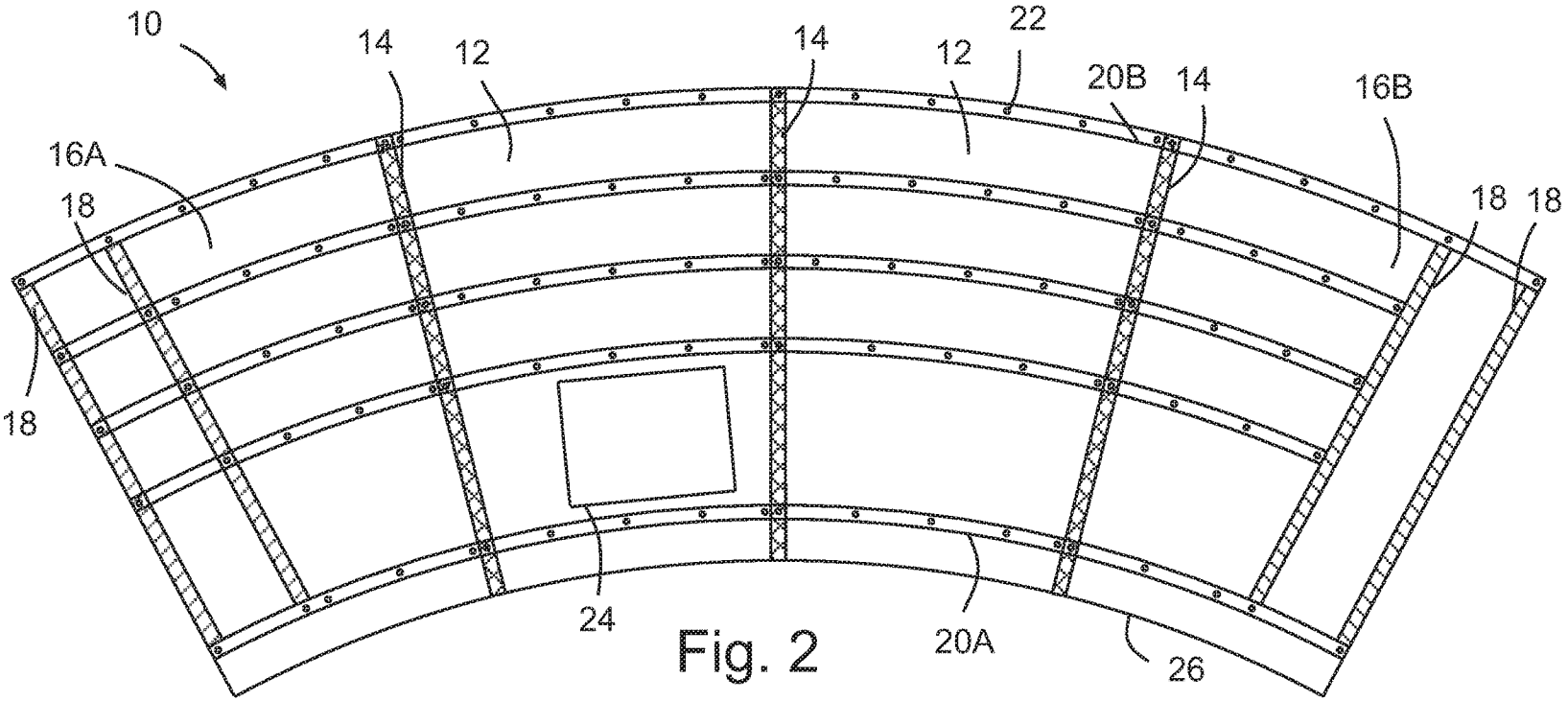
FIG. 2 is a drawing of another embodiment of a covering for a rig structure in a flat, pre-installation configuration.

FIG. 2 shows another embodiment of the covering. This embodiment is larger in height than the covering shown in FIG. 1 and has intermediate flaps between lower flap 20A and upper flap 20B. The intermediate flaps, in the embodiment shown, do not extend over the end connector strips 18 of end segment 16B as this portion of the covering is overlapped when installed by the corresponding end connector strips 18 of end segment 16A. In an exemplary version of the embodiment shown in FIG. 2, the upper and lower flaps are five feet apart measured from top edge to top edge and the intermediate flaps are each one foot apart measured from top edge to top edge.

Figure 3:
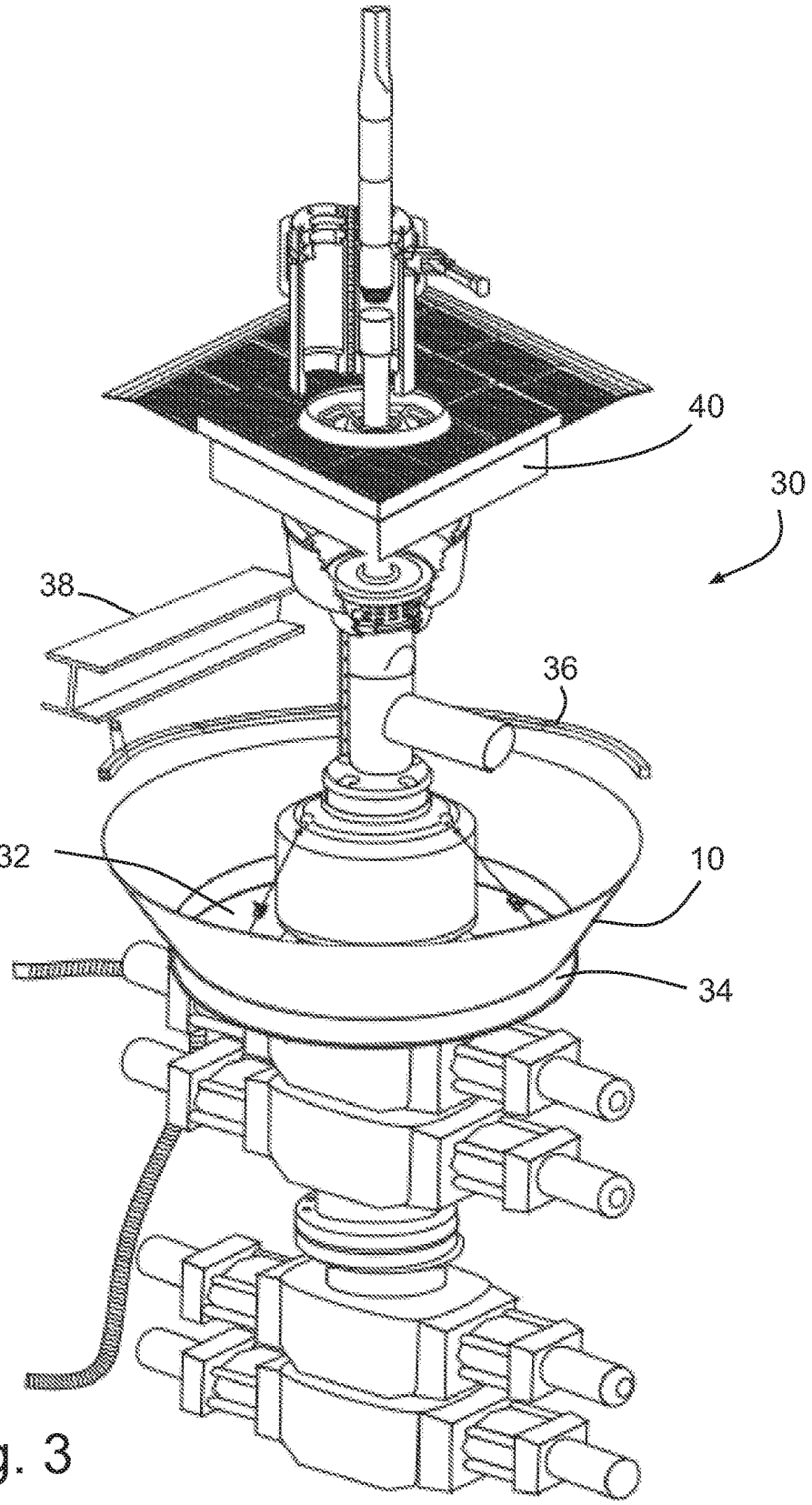
FIG. 3 is a drawing of an embodiment of a covering for a rig structure installed on a rig structure.

FIG. 3 shows an embodiment of the covering 10 installed on a rig structure, here drilling rig 30. The covering 10 is arranged around elements of the drilling rig 30 to capture fluids from the drilling rig elements. The covering is connected around base 32, which in FIG. 3 is a containment basin which receives and contains the fluid captured by the covering. The covering 10 shown in FIG. 3 is funnel shaped, in particular frustoconical, when installed, but other embodiments could have other shapes, for example irregular shapes or other tubular shapes such as a cylinder or a pyramidal frustum. Skirt 26 (see FIG. 1) at the lower edge of the covering 10 lies within an outer containment wall 34 of containment basin 32 so that fluids caught by the covering 10 flow into the containment basin 32. Frame 36, which may be telescopically adjustable, is shown here a distance above the top edge of the covering 10. The covering 10 may be suspended from frame 36 using connectors such as zip ties, hangers and tabs (not shown) attached to the upper flap of the covering and would typically be located closer to the top of the covering than shown here. Frame 36 can also be attached to an intermediate flap, in an embodiment having one or more intermediate flaps, if desired. Frame 36 may be substantially planar for convenience of attachment to the top edge of covering 10 in embodiments, like those shown, where the covering is adapted to have the top edge in a substantially planar orientation when installed, but the frame and the covering could have other shapes. Frame 36 may be suspended from one or more rig structure elements, represented schematically in FIG. 3 by I-beam 38. The frame may be, for example, made of one or more arc-shaped segments connected end-to-end to form a generally circular frame with telescopically adjustable connections between the ends of the segments to adjust the circumference of the frame. In an embodiment, the frame comprises three hollow arc-shaped segments, each having a larger diameter end and a smaller diameter end, so that each larger diameter end can receive a smaller diameter end, and the ends of the segments comprise plural pairs of holes, the connections formed by larger diameter ends receiving smaller diameter ends being telescopically adjustable to align different pairs of holes together based on the telescopic adjustment and securable by extending bolts through aligned pairs of holes. Containment basin 32 may also be suspended from one or more rig structure elements. In an embodiment, containment basin 32 and frame 36 may be suspended from the same structural element of the drilling rig, for example platform 40. In an embodiment, the covering 10 may be suspended directly from a structural element of the rig structure without using frame 36. The covering 10 may be connected to frame 36 or to other elements using connectors that supply tension to the covering to maintain the covering in a substantially taut condition. The aforementioned zip ties, hangers and tabs may be arranged to supply tension. Typically, lower flap 20A is connected to containment basin 32 or to other elements and the lower end of covering 10 comprises a skirt 26 that hangs below lower flap 20A and is not taut.

The covering 10 may be adjustable in size circumferentially by adding or removing segments 12. The covering 10 may also be adjustable in size vertically by connecting a flap to another flap. In embodiments in which the covering is smaller at the bottom, such as the embodiments shown in the figures, this connection between flaps may result in the normally upper of the connected flaps being pinched inwards by the normally lower of the connected flaps, resulting in circumferential slack in the covering near the normally upper of the connected flaps when the covering is installed on a rig structure. Also, portions of the covering between the connected flaps may have vertical slack whether or not the covering is smaller at the bottom. The top edge of the covering may still be circumferentially taut in these circumstances if it is not one of the connected flaps or if the normally lower of the connected flaps is not smaller than the normally upper of the connected flaps, and portions of the covering that are not between the connected flaps and are between flaps that are connected to frame 36 or to containment basin 32 or to other elements may still be vertically taut in these circumstances.

To install a covering as described above on a rig structure, typically a base, which may be an oil containment basin, is installed first. In an alternative embodiment the base may comprise a supporting element that supports an oil containment basin. The base is installed by securing the base to the rig structure, typically by suspending the base from a structural element of the rig structure. The covering may be arranged around a portion of the rig structure to be enclosed and connected to form a loop around the portion of the rig structure. In an embodiment in which there are end connectors different from other connectors, for example as shown in FIGS. 1 and 2, then typically the end connectors are connected last to form the loop. A flap, typically lowermost flap 20A, may be connected to the base, containment basin, or to one or more other elements such that the bottom skirt of covering 10 lies within outer containment wall 34 of containment basin 32, before or after the covering is connected to form a loop. Another flap, typically uppermost flap 20B, is connected to frame 36, also before or after the covering is connected to form a loop. These steps may occur with the frame not yet in installed position. The frame can then be raised by shortening connectors suspending it from rig structure elements until the covering is in a substantially taut condition. Alternatively the frame may be placed in installed position first and the covering connected to the frame afterwards. The frame could also be omitted and the covering connected to other elements.

Immaterial modifications may be made to the embodiments described here without departing from what is covered by the claims.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A method for enclosing a rig structure, comprising the steps of:

providing a base and a flexible sheet-form covering having a first edge and a second edge, the flexible sheet-form covering comprising plural sheet-form segments separably connected in series, each of the plural sheet-form segments being movable between a circumferential slack condition to a substantially circumferentially taut condition and between a vertical slack condition to a substantially vertically taut condition, the flexible sheet-form covering having a circumference, and each segment being adapted to connect to each other segment at overlapping edges of the respective segments;

arranging the flexible sheet-form covering around a portion of the rig structure;

connecting the overlapping edges of the sheet-form segments together to form a loop around the portion of the rig structure using connectors between the overlapping edges of the sheet-form segments that supply tension to each of the plural sheet-form segments when connected so that each of the plural sheet-form segments are in the substantially circumferentially taut condition;

securing the base to the rig structure;

securing the first edge of the covering around a perimeter of the base;

securing the second edge of the covering in spaced relation to the base with tension applied to the covering to maintain each of the plural sheet-form segments in the substantially vertically taut condition;

removing or adding segments to modify the circumference of the flexible sheet-form covering; and maintaining the substantially circumferentially taut condition after the adding or removing of segments.

2. The method of claim 1 in which the step of securing the base to the rig structure comprises at least in part supporting the base by suspending the base from a structural element of the rig structure.

3. The method of claim 2 in which the structural element comprises a platform of the rig structure.

4. The method of claim 2 in which the second edge of the covering is supported by suspension from the structural element from which the base is suspended.

5. The method of claim 1 in which the second edge of the covering is supported by suspension from a part of the rig structure.

6. The method of claim 1 in which the second edge of the covering is secured to a peripheral frame.

7. The method of claim 6 in which the peripheral frame is a telescopically adjustable annular frame.

8. The method of claim 1 in which the base comprises an oil containment basin adapted to capture and contain any oil that falls onto the base.

9. The method of claim 1 in which the covering, when taut, has at least a tubular portion.

10. The method of claim 9 in which the at least a tubular portion is funnel shaped.

11. The method of claim 1 in which the covering comprises a lower flap proximate to the first edge, and securing the first edge of the covering around the perimeter of the base is carried out by securing the lower flap around the perimeter of the base.

12. The method of claim 1 in which the covering comprises an upper flap proximate to the second edge, and securing the second edge of the covering in spaced relation to the base is carried out by securing the upper flap in spaced relation to the base.

13. The method of claim 1 in which one or more of the segments has one or more holes formed in the segment.

* * * * *